United States Patent [19]

Counts

[11] Patent Number: 5,051,662

[45] Date of Patent: Sep. 24, 1991

[54] FLUORESCENT LAMP SYSTEM

[75] Inventor: Richard C. Counts, Dallas, Tex.

[73] Assignee: USI Lighting, Inc., San Leandro, Calif.

[21] Appl. No.: 500,008

[22] Filed: Mar. 27, 1990

[51] Int. Cl.[5] ..... H05B 41/14

[52] U.S. Cl. ..... 315/247; 315/209 R; 315/219; 315/223; 315/DIG. 7

[58] Field of Search ..... 315/247, 219, DIG. 7, 315/209 R, 223, 307, 205, 240

[56] References Cited

U.S. PATENT DOCUMENTS

| | | | |
|---|---|---|---|
| 4,259,614 | 3/1981 | Kohler | 315/219 |
| 4,277,728 | 7/1981 | Stevens | 315/307 |
| 4,370,600 | 1/1983 | Zansky | 315/244 |
| 4,506,195 | 3/1985 | Elms | 315/205 |
| 4,652,797 | 3/1987 | Nilssen | 315/209 R |
| 4,874,989 | 10/1989 | Nilssen | 315/DIG. 5 |

*Primary Examiner*—Eugene R. LaRoche
*Assistant Examiner*—Son Dinh
*Attorney, Agent, or Firm*—Thomas E. Schatzel

[57] ABSTRACT

A fluorescent lamp system utilizes boost power factor correction. The fluorescent lamp system includes a power source, a reference voltage and a fluorescent lamp. A resonant circuit supplies power to the fluorescent lamp. A first capacitor is connected between a first end of the resonant circuit and the reference voltage. A second capacitor is connected between the first end of the resonant circuit and the power source. A first switch is connected between a second end of the resonant circuit and the reference voltage. A second switch is connected between the second end of the resonant circuit and the power source. A control module operates the first switch and the second switch so that the resonant circuit operates at near resonant frequency. The control module is integrated on a single integrated circuit. The first switch and the second switch may be also integrated on the single integrated circuit. Alternately, only one of the switches, or neither of the switches may be integrated on the single integrated circuit.

11 Claims, 2 Drawing Sheets

FLUORESCENT LAMP SYSTEM

BACKGROUND

The present invention concerns a fluorescent lamp system which includes circuitry utilizing boost power factor correction.

Ballast circuitry is used to convert an incoming AC voltage signal to a high DC voltage signal. The incoming AC voltage signal typically has an RMS voltage of either 120 volts or 277 volts. The high DC voltage is converted to a high frequency AC voltage which is applied to a series resonant/lamp circuit.

It is a goal in designing such systems to minimize complexity and cost of ballast circuitry while providing for reliability and versatility. One way to produce efficient circuitry is to place control circuitry on a single integrated circuit. See for example, U.S. Pat. No. 4,866,350 issued to Richard C. Counts. However, integration of all control circuitry on a single integrated circuit can limit the ability to interchange components. Additionally, integration of all circuitry on a single integrated circuit can result in a reduction of power handling capability due to inherent power limitations of an integrated circuit.

SUMMARY OF THE INVENTION

In accordance with the preferred embodiment of the present invention, a fluorescent lamp system is presented which utilizes boost power factor correction. The fluorescent lamp system includes a power source, a reference voltage and a fluorescent lamp. A resonant circuit, for example a capacitor and an inductor connected in series, supplies power to the fluorescent lamp. A first capacitor is connected between a first end of the resonant circuit and the reference voltage. A second capacitor is connected between the first end of the resonant circuit and the power source. A first switch is connected between a second end of the resonant circuit and the reference voltage. A second switch is connected between the second end of the resonant circuit and the power source. A control module operates the first switch and the second switch so that the resonant circuit operates at near resonant frequency.

The control module is integrated on a single integrated circuit. The first switch and the second switch may be also integrated on the single integrated circuit. Alternately, only one of the switches, or neither of the switches may be integrated on the single integrated circuit.

The power source includes an AC power signal source which provides an AC power signal. A rectifier rectifies the AC signal. The rectified AC signal is used to charge a capacitor. An inductor, a diode and a switch are used to control the rate at which the capacitor is charged. The switch is operated by the control module so as to optimize power factor correction. The switch may or may not be integrated on the single integrated circuit. The rectifier is not integrated on the single integrated circuit.

In the present invention, partial integration of control circuitry facilitates variation of the external components and overcomes the inherent power limitations which occur when all control circuitry is integrated on a single integrated circuit.

DESCRIPTION OF THE PREFERRED EMBODIMENT

Figure 1:
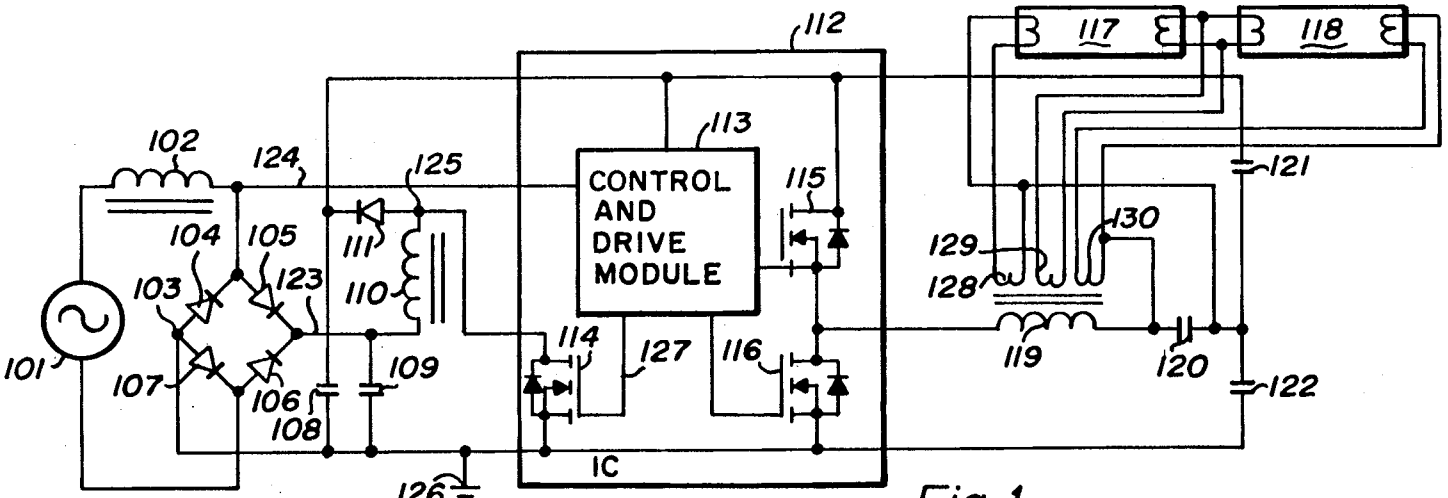
FIGS. 1 through 4 show alternate embodiments of a fluorescent lamp system having ballast circuitry that includes boost power factor correction in accordance with the present invention.

In FIG. 1 is shown a fluorescent lamp system. An AC signal source 101 represents the AC signal from a power source such as a standard electrical outlet. The RMS voltage of the AC signal is typically 120 volts or 277 volts. An inductor 101 is used to provide RFI filtering between the incoming AC voltage signal and a rectifier 103. Rectifier 103 consists of diodes 104, 105, 106 and 107 connected as shown. Rectifier 103 produces a rectified AC signal which is placed on a line 123.

Charge stored within a capacitor 108 is used to provide a high DC level signal on a line 124. Capacitor 108 is charged by current provided from an inductor 110 through a diode 111. When the AC signal from AC signal source 101 is at greater voltage amplitudes, current energy is stored in inductor 110. When the AC signal is at lesser voltage amplitudes, energy stored in inductor 110 is used to charge capacitor 108. A capacitor 109 is used in conjunction with inductor 102 to provide RFI filtering.

Energy is stored within inductor 110 by turning on a switch 114. When switch 114 is turned on, an end 125 of inductor 110 is connected to a ground 126. This causes energy in the form of current flow to be stored in inductor 110. When switch 114 is turned off, this current is forced to flow through diode 111 and to charge capacitor 108. Switch 114 is switched on and off by a control signal on a line 127. The control signal is generated by a control and drive module 113. Control and drive module 113 causes switch 114 to be switched on and off in a pattern such that current drawn from AC signal source 101 varies synchronously with the voltage amplitude of the AC signal from AC signal source 101.

A fluorescent lamp 117 and a fluorescent lamp 118 are powered by a voltage across a capacitor 120. An inductor 119 is placed in series with capacitor 120. A loop 128, a loop 129 and a loop 130 are used to provide current which heat the filaments of fluorescent lamp 117 and fluorescent lamp 118.

Control and drive module 113 control a switch 115 and a switch 116 so that the LC circuit composed of inductor 119 and capacitor 120 oscillates at near resonance frequency. This provides the high voltage across capacitor 120 needed to power fluorescent lamp 117 and fluorescent lamp 118. A capacitor 121 and a capacitor 122 are placed as shown so that along with inductor 119, capacitor 120 and switches 115 and 116 a half bridge series resonant circuit is formed.

The fluorescent lamp system shown in FIG. 1 may be designed for a power source RMS voltage of either 120 volts or 277 volts. For example, when the power source RMS voltage is 120 volts, inductor 102 has an inductance of 1.25 millihenries; diodes 104, 105, 106 and 107 are each 1N4003 diodes; capacitor 109 has a capacitance of 1 microfarad (200 volts); capacitor 108 has a capacitance of 33 microfarads (350 volts); inductor 110 has an inductance of 750 microhenries: diode 111 is a fast recovery diode FR105; inductor 119 has an inductance of 2.45 millihenries; capacitor 120 has a capacitance of 0.012 microfarads (600 volts); capacitor 121 has a capacitance of 0.047 microfarads (400 volts); and capacitor 122 has a capacitance of 0.047 microfarads (400 volts).

Similarly, for example, when the power source RMS voltage is 277 volts, inductor 102 has an inductance of 1.25 millihenries; diodes 104, 105, 106 and 107 are each 1N4005 diodes; capacitor 109 has a capacitance of 0.33 microfarad (450 volts); capacitor 108 has a capacitance of 22 microfarads (450 volts); inductor 110 has an inductance of 450 microhenries; diode 111 is a fast recovery diode FR105; inductor 119 has an inductance of 3.21 millihenries; capacitor 120 has a capacitance of 0.0082 microfarads (600 volts); capacitor 121 has a capacitance of 0.047 microfarads (400 volts); and capacitor 122 has a capacitance of 0.047 microfarads (400 volts).

In FIG. 1, switches 114, 115 and 116 are MOSFET transistors integrated on integrated circuit 112. The half bridge series resonant configuration of the fluorescent lamp system of FIG. 1, with switches 115 and 116 being integrated on integrated circuit 112 and capacitors 121 and 122 located off integrated circuit 112, provides inherent power factor correction along with lower cost and improved efficiently over the full bridge configuration of the prior art. Further, since rectifier 103 is not integrated on integrated circuit 112, this allows for higher versatility and higher rating of ballast over prior art circuits in which a rectifier has been integrated onto an integrated circuit.

Figure 2:
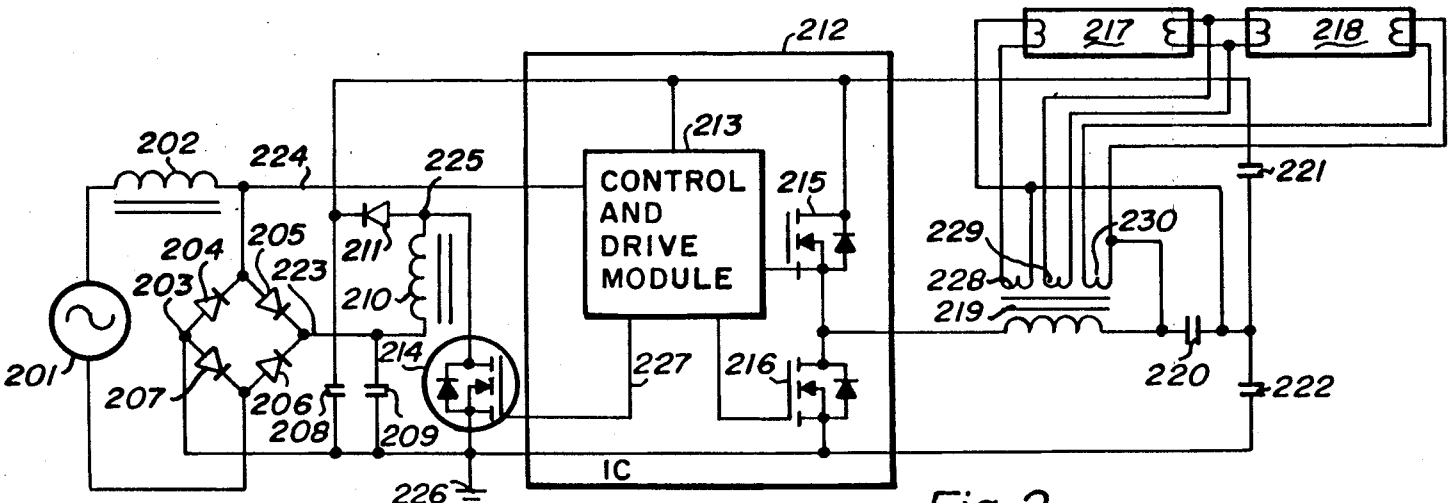

In FIG. 2 is shown a fluorescent lamp system, similar to that shown in FIG. 1. An AC signal source 201 represents the AC signal from a power source such as a standard electrical outlet. The RMS voltage of the AC signal is typically 120 volts or 277 volts. An inductor 201 is used to provide RFI filtering between the incoming AC voltage signal and a rectifier 203. Rectifier 203 consists of diodes 204, 205, 206 and 207 connected as shown. Rectifier 203 produces a rectified AC signal which is placed on a line 223.

Charge stored within a capacitor 208 is used to provide a high DC level signal on a line 224. Capacitor 208 is charged by current provided from an inductor 210 through a diode 211. When the AC signal from AC signal source 201 is at greater voltage amplitudes, current energy is stored in inductor 210. When the AC signal is at lesser voltage amplitudes, energy stored in inductor 210 is used to charge capacitor 208. A capacitor 209 is used in conjunction with inductor 202 to provide RFI filtering.

Energy is stored within inductor 210 by turning on a switch 214. When switch 214 is turned on, an end 225 of inductor 210 is connected to a ground 226. This causes energy in the form of current flow to be stored in inductor 210. When switch 214 is turned off, this current is forced to flow through diode 211 and to charge capacitor 208. Switch 214 is switched on and off by a control signal on a line 227. The control signal is generated by a control and drive module 213. Control and drive module 213 causes switch 214 to be switched on and off in a pattern such that current drawn from AC signal source 201 varies synchronously with the voltage amplitude of the AC signal from AC signal source 201.

A fluorescent lamp 217 and a fluorescent lamp 218 are powered by a voltage across a capacitor 220. An inductor 219 is placed in series with capacitor 220. A loop 228, a loop 229 and a loop 230 are used to provide current which heat the filaments of fluorescent lamp 217 and fluorescent lamp 218.

Control and drive module 213 control a switch 215 and a switch 216 so that the LC circuit composed of inductor 219 and capacitor 220 oscillates at near resonance frequency. This provides the high voltage across capacitor 220 needed to power fluorescent lamp 217 and fluorescent lamp 218. A capacitor 221 and a capacitor 222 are placed as shown so that along with inductor 219, capacitor 220 and switches 215 and 216 a half bridge series resonant circuit is formed.

The fluorescent lamp system shown in FIG. 2 may be designed for a power source RMS voltage of either 120 volts or 277 volts. The values for components in the circuit shown in FIG. 2 can be the same as the values for the components in the circuit shown in FIG. 1. For example, when the power source RMS voltage is 120 volts, inductor 202 has an inductance of 1.25 millihenries; diodes 204, 205, 206 and 207 are each 1N4003 diodes; capacitor 209 has a capacitance of 1 microfarad (200 volts); capacitor 208 has a capacitance of 33 microfarads (350 volts); inductor 210 has an inductance of 750 microhenries; diode 211 is a fast recovery diode FR105; inductor 219 has an inductance of 2.45 millihenries; capacitor 220 has a capacitance of 0.012 microfarads (600 volts); capacitor 221 has a capacitance of 0.047 microfarads (400 volts); and capacitor 222 has a capacitance of 0.047 microfarads (400 volts). Switches Similarly, for example, when the power source RMS voltage is 277 volts, inductor 202 has an inductance of 1.25 millihenries; diodes 204, 205, 206 and 207 are each 1N4005 diodes; capacitor 209 has a capacitance of 0.33 microfarad (450 volts); capacitor 208 has a capacitance of 22 microfarads (450 volts); inductor 210 has an inductance of 450 microhenries; diode 211 is a fast recovery diode FR105; inductor 219 has an inductance of 3.21 millihenries; capacitor 220 has a capacitance of 0.0082 microfarads (600 volts); capacitor 221 has a capacitance of 0.047 microfarads (400 volts); and capacitor 222 has a capacitance of 0.047 microfarads (400 volts).

In FIG. 2, switches 215 and 216 are MOSFET transistors integrated on integrated circuit 212. The fluorescent lamp system of FIG. 2 differs from the fluorescent lamp system of FIG. 1 in that switch 214 is not integrated on integrated circuit 212. When the power source RMS voltage is 120 volts, switch 214 may be, for example, an IRF 720 MOSFET transistor. When the power source RMS voltage is 277 volts, switch 214 may be, for example, an IRF 820 MOSFET transistor. Removing switch 214 from integrated circuit 212 allows for greater power capability due to the inherent power limitations of integrated circuits such as integrated circuit 212.

Figure 3:
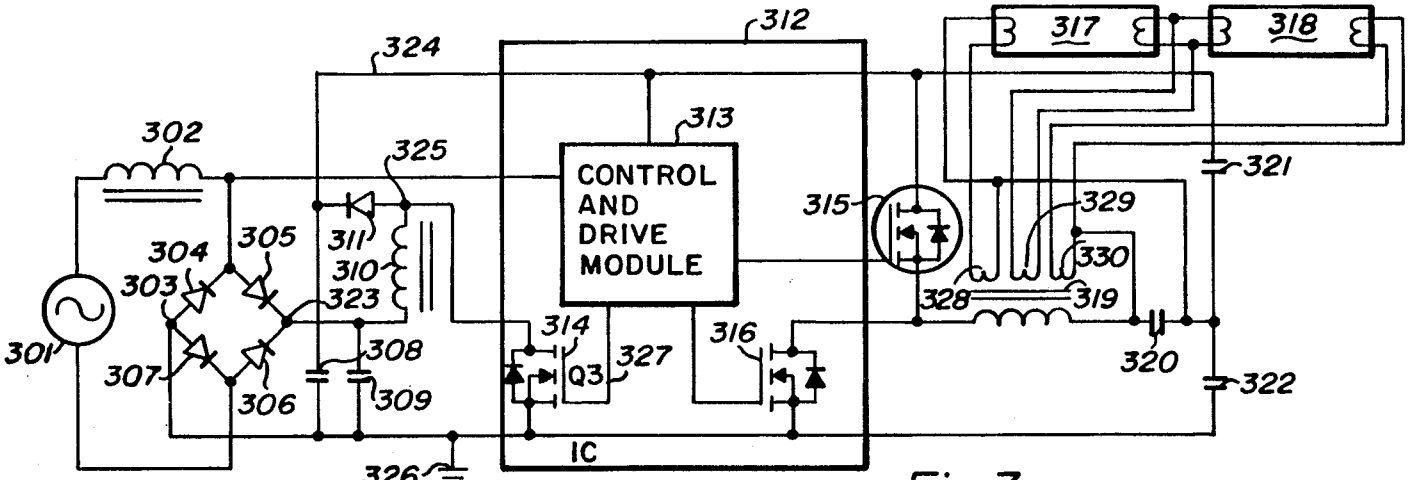

In FIG. 3 is shown a fluorescent lamp system, similar to that shown in FIG. 1 and FIG. 2. An AC signal source 301 represents the AC signal from a power source such as a standard electrical outlet. An inductor 301 is used to provide RFI filtering between the incoming AC voltage signal and a rectifier 303. Rectifier 303 consists of diodes 304, 305, 306 and 307 connected as shown. Rectifier 303 produces a rectified AC signal which is placed on a line 323.

Charge stored within a capacitor 308 is used to provide a high DC level signal on a line 324. Capacitor 308 is charged by current provided from an inductor 310 through a diode 311. When the AC signal from AC signal source 301 is at greater voltage amplitudes, current energy is stored in inductor 310. When the AC signal is at lesser voltage amplitudes, energy stored in inductor 310 is used to charge capacitor 308. A capacitor 309 is used in conjunction with inductor 302 to provide RFI filtering.

Energy is stored within inductor 310 by turning on a switch 314. When switch 314 is turned on, an end 325 of inductor 310 is connected to a ground 326. This causes energy in the form of current flow to be stored in inductor 310. When switch 314 is turned off, this current is forced to flow through diode 311 and to charge capacitor 308. Switch 314 is switched on and off by a control signal on a line 327. The control signal is generated by a control and drive module 313. Control and drive module 313 causes switch 314 to be switched on and off in a pattern such that current drawn from AC signal source 301 varies synchronously with the voltage amplitude of the AC signal from AC signal source 301.

A fluorescent lamp 317 and a fluorescent lamp 318 are powered by a voltage across a capacitor 320. An inductor 319 is placed in series with capacitor 320. A loop 328, a loop 329 and a loop 330 are used to provide current which heat the filaments of fluorescent lamp 317 and fluorescent lamp 318.

Control and drive module 313 control a switch 315 and a switch 316 so that the LC circuit composed of inductor 319 and capacitor 320 oscillates at near resonance frequency. This provides the high voltage across capacitor 320 needed to power fluorescent lamp 317 and fluorescent lamp 318. A capacitor 321 and a capacitor 322 are placed as shown so that along with inductor 319, capacitor 320 and switches 315 and 316 a half bridge series resonant circuit is formed.

The fluorescent lamp system shown in FIG. 3 may be designed for a power source RMS voltage of either 120 volts or 277 volts. The values for components in the circuit shown in FIG. 3 can be the same as the values for the components in the circuit shown in FIG. 1 and FIG. 2.

In FIG. 3, switches 314 and 316 are MOSFET transistors integrated on integrated circuit 312. The fluorescent lamp system of FIG. 3 differs from the fluorescent lamp system of FIG. 1 in that switch 315 is not integrated on integrated circuit 312. When the power source RMS voltage is 120 volts, switch 315 may be, for example, an IRF 710 MOSFET transistor. When the power source RMS voltage is 277 volts, switch 315 may be, for example, an IRF 820 MOSFET transistor. Removing switch 315 from integrated circuit 312 allows for greater power capability due to the inherent power limitations of integrated circuits such as integrated circuit 312. Also, where it is a goal to integrate both switch 315 and switch 316 onto integrated circuit 312, integration of only one switch, in this case switch 316, is a logical first step.

Figure 4:
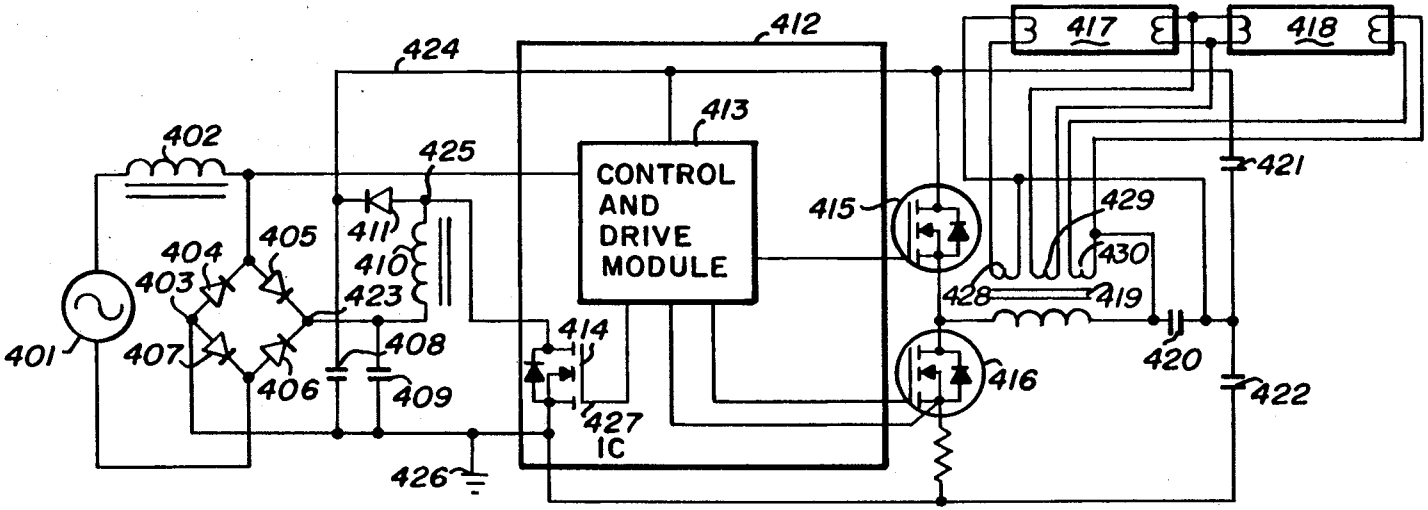

In FIG. 4 is shown a fluorescent lamp system, similar to that shown in FIG. 1 and FIG. 2. An AC signal source 401 represents the AC signal from a power source such as a standard electrical outlet. An inductor 401 is used to provide RFI filtering between the incoming AC voltage signal and a rectifier 403. Rectifier 403 consists of diodes 404, 405, 406 and 407 connected as shown. Rectifier 403 produces a rectified AC signal which is placed on a line 423.

Charge stored within a capacitor 408 is used to provide a high DC level signal on a line 424. Capacitor 408 is charged by current provided from an inductor 410 through a diode 411. When the AC signal from AC signal source 401 is at greater voltage amplitudes, current energy is stored in inductor 410. When the AC signal is at lesser voltage amplitudes, energy stored in inductor 410 is used to charge capacitor 408. A capacitor 409 is used in conjunction with inductor 402 to provide RFI filtering.

Energy is stored within inductor 410 by turning on a switch 414. When switch 414 is turned on, an end 425 of inductor 410 is connected to a ground 426. This causes energy in the form of current flow to be stored in inductor 410. When switch 414 is turned off, this current is forced to flow through diode 411 and to charge capacitor 408. Switch 414 is switched on and off by a control signal on a line 427. The control signal is generated by a control and drive module 413. Control and drive module 413 causes switch 414 to be switched on and off in a pattern such that current drawn from AC signal source 401 varies synchronously with the voltage amplitude of the AC signal from AC signal source 401.

A fluorescent lamp 417 and a fluorescent lamp 418 are powered by a voltage across a capacitor 420. An inductor 419 is placed in series with capacitor 420. A loop 428, a loop 429 and a loop 430 are used to provide current which heat the filaments of fluorescent lamp 417 and fluorescent lamp 418.

Control and drive module 413 control a switch 415 and a switch 416 so that the LC circuit composed of inductor 419 and capacitor 420 oscillates at near resonance frequency. This provides the high voltage across capacitor 420 needed to power fluorescent lamp 417 and fluorescent lamp 418. A capacitor 421 and a capacitor 422 are placed as shown so that along with inductor 419, capacitor 420 and switches 415 and 416 a half bridge series resonant circuit is formed.

The fluorescent lamp system shown in FIG. 4 may be designed for a power source RMS voltage of either 120 volts or 277 volts. The values for components in the circuit shown in FIG. 4 can be the same as the values for the components in the circuit shown in FIG. 1 and FIG. 2.

In FIG. 4, switch 414 is a MOSFET transistor integrated on integrated circuit 412. The fluorescent lamp system of FIG. 4 differs from the fluorescent lamp system of FIG. 1 in that switch 415 and switch 416 are not integrated on integrated circuit 412. When the power source RMS voltage is 120 volts, switch 415 and switch 416 may each be, for example, an IRF 710 MOSFET transistor. When the power source RMS voltage is 277 volts, switch 415 and switch 416 may each be, for example, an IRF 820 MOSFET transistor. Removing switches 415 and 416 from integrated circuit 412 allows for greater power capability due to the inherent power limitations of integrated circuits such as integrated circuit 412. Also, removing switches 415 and 416 from integrated circuit 412 allows for flexibility and facilitates variation in the components which implement switches 415 and 416.

I claim:

1. A fluorescent lamp system comprising:

a power source;

a reference voltage;

a fluorescent lamp;

a resonant circuit, coupled to the fluorescent lamp, the resonant circuit having a first end and a second end;

a first capacitance coupled between the first end of the resonant circuit and the reference voltage;

a second capacitance coupled between the first end of the resonant circuit and the power source;

a first switch coupled between the second end of the resonant circuit and the reference voltage;

a second switch coupled between the second end of the resonant circuit and the power source;

control means, coupled to the first switch and the second switch, for operating the first switch and the second switch so that the resonant circuit operates at near resonant frequency; and wherein the control means, the first switch and the second switch are all integrated on a single integrated circuit.

2. A fluorescent lamp system comprising:

a power source including an AC power signal source providing and AC power signal, rectifying means, coupled to the AC power signal source for rectifying the AC power signal, capacitance means, connected to the reference, for storing a charge creating a voltage potential, and capacitance charging means, coupled to the capacitance means and the rectifying means, for transferring charge from the rectifying means to the capacitance means, the capacitance charging means including a switch, operated by the control means to optimize power factor correction;

a reference voltage;

a fluorescent lamp;

a resonant circuit, coupled to the fluorescent lamp, the resonant circuit having a first end and a second end;

a first capacitance coupled between the first end of the resonant circuit and the power source;

a second capacitance coupled between the first end of the resonant circuit and the power source;

a first switch coupled between the second end of the resonant circuit and the reference voltage;

a second switch coupled between the second end of the resonant circuit and the power source; and, control mean, coupled to the first switch and the second switch, for operating the first switch and the second switch so that the resonant circuit operates at near resonant frequency.

3. A fluorescent lamp system as in claim 2 wherein the control means is integrated on a single integrated circuit and the third switch is not integrated on the single integrated circuit.

4. A fluorescent lamp system as in claim 2 wherein the control means and the third switch are integrated on a single integrated circuit.

5. A fluorescent lamp system as in claim 2 wherein the control means is integrated on a single integrated circuit and the rectifying means is not integrated on the single integrated circuit.

6. A fluorescent lamp system as in claim 4 wherein the the first switch and the second switch are also integrated on the single integrated circuit.

7. A fluorescent lamp system as in claim 4 wherein the the first switch is integrated on the single integrated circuit, and the second switch is not integrated on the single integrated circuit.

8. A fluorescent lamp system as in claim 4 wherein the first switch and the second switch are not integrated on the single integrated circuit.

9. A fluorescent lamp system comprising:

a power source;

a reference voltage;

a fluorescent lamp;

a resonant circuit, coupled to the fluorescent lamp, the resonant circuit having a first end and a second end;

a first capacitance coupled between the first end of the resonant circuit and the reference voltage;

a second capacitance coupled between the first end of the resonant circuit and the power source;

a first switch coupled between the second end of the resonant circuit and the reference voltage;

a second switch coupled between the second end of the resonant circuit and the power source;

control means, coupled to the first switch and the second switch, for operating the first switch and the second switch so that the resonant circuit operates at near resonant frequency; and wherein the control means and the first switch are integrated on a single integrated circuit, and the second switch is not integrated on the single integrated circuit.

10. A fluorescent lamp system comprising:

a power source;

a reference voltage;

a fluorescent lamp;

a resonant circuit, coupled to the fluorescent lamp, the resonant circuit having a first end and a second end;

a first capacitance coupled between the first end of the resonant circuit and the power source;

a second capacitance coupled between the second end of the resonant circuit and the power source;

a first switch coupled between the second end of the resonant circuit and the reference voltage;

a second switch coupled between the second end of the resonant circuit and the power source;

control mean, coupled to the first switch and the second switch, for operating the first switch and the second switch so that the resonant circuit operates at near resonant frequency; and wherein the control means is integrated on a single integrated circuit and the first switch and the second switch are not integrated on the single integrated circuit.

11. A fluorescent lamp system comprising:

a power source;

a reference voltage;

a fluorescent lamp;

a resonant circuit, coupled to the fluorescent lamp, the resonant circuit including a capacitance and an inductance coupled in series and having a first end and a second end;

a first capacitance coupled between the first end of the resonant circuit and the power source;

a second capacitance coupled between the first end of the resonant circuit and the power source;

a first switch coupled between the second end of the resonant circuit and the reference voltage;

a second switch coupled between the second end of the resonant circuit and the power source; and, control mean, coupled to the first switch and the second switch, for operating the first switch and the second switch so that the resonant circuit operates at near resonant frequency.

* * * * *